United States Patent [19]

Vinzetta

[11] Patent Number: 4,723,780

[45] Date of Patent: Feb. 9, 1988

[54] GOLF PRACTICE DEVICE

[76] Inventor: Jerry P. Vinzetta, 1748 George Pl., Southaven, Miss. 38671

[21] Appl. No.: 919,714

[22] Filed: Oct. 16, 1986

[51] Int. Cl.[4] ..... A63B 69/36

[52] U.S. Cl. ..... 273/181 A; 273/407

[58] Field of Search ..... 273/181 A, 181 R, 182 R, 273/26 A, 181 F, 394, 410, 411, 29 A, 396, 397, 407

[56] References Cited

U.S. PATENT DOCUMENTS 2,899,208 5/1959 Wallsteiner ..... 273/182 R 3,408,071 10/1968 Lundy ..... 273/26 A

*Primary Examiner*—George J. Marlo

*Attorney, Agent, or Firm*—William F. Frank

[57] ABSTRACT

A practice device including a single net enclosure into which golf balls may be driven wherein a U-shaped canopy is pivotally attached to the upper ends of vertical support members and is held in position for use by brackets which are pivotally attached to the upper portions of the vertical support members and secured to the lower end of the canopy by a bolt and nut arrangement. Lateral support members are similarly attached to the lower end portions of the vertical support members. Additionally, the vertical support members can be adjusted in height without disassembly of the device.

5 Claims, 12 Drawing Figures

GOLF PRACTICE DEVICE

FIELD OF INVENTION

The present invention is in the field of devices which permit a player to practice hitting balls without having to go some distance to retrieve the balls. Specifically the invention permits a golfer to practice his golfswing for all strokes.

BACKGROUND OF THE INVENTION

Ideally, the preferred manner to learn to hit golf balls, particularly drives, is to go to a driving range where there is usually a person sufficiently experienced to give instruction and then to hit balls out onto a driving range. Unfortunately, this manner of practicing requires locating such a range and then driving to it. Being out of doors, weather can often prevent using the range.

The best alternative is to have a means on one's property which will permit practice whenever the player wishes. To this end, there are several models of practice nets for use on one's property. These presently available practice nets are constructed of a frame comprising two spaced apart vertical supports, a canopy attached to the upper ends of the supports and extending toward the player and lateral support members attached to the lower ends of the vertical support members and extending outwardly toward the player. A net is attached by various means to the frame to provide an enclosure into which balls can be hit. The device is usually supplied in disassembled form, the components of the frame requiring assembly into a rigid form. The present devices have several disadvantages. The height of the assembled frame is fixed, thus severely limiting where it can be used undercover such as a garage or even in a home. The device is difficult to move once assembled, usually requiring two or more people. The device cannot be easily placed in storage without disassembly.

SUMMARY OF THE PRESENT INVENTION

The present invention is an improvement over the known art in that the canopy is pivotally attached to the upper ends of the vertical support members and is held in position for use by bracket means which are pivotally attached to the upper portions of the vertical support members and secured to the lower end of the canopy by a bolt and locking nut arrangement. The lateral group support members are similarly attached to the lower end portions of the vertical support members. Additionally, the vertical support members can be adjusted in height in 6 inch increments. To move or store the present invention requires only loosening the bolt and locking nut arrangements, disengaging the brackets, folding the canopy down to the vertical support members and folding the ground support members upwardly to the vertical support members. There is no need to remove the net once the present invention is assembled.

BRIEF DESCRIPTION OF THE DRAWINGS

The present invention can be seen in the accompanying drawing figures which are illustrative of the preferred embodiment of the invention.

DETAILED DESCRIPTION OF THE INVENTION

Figure 1:
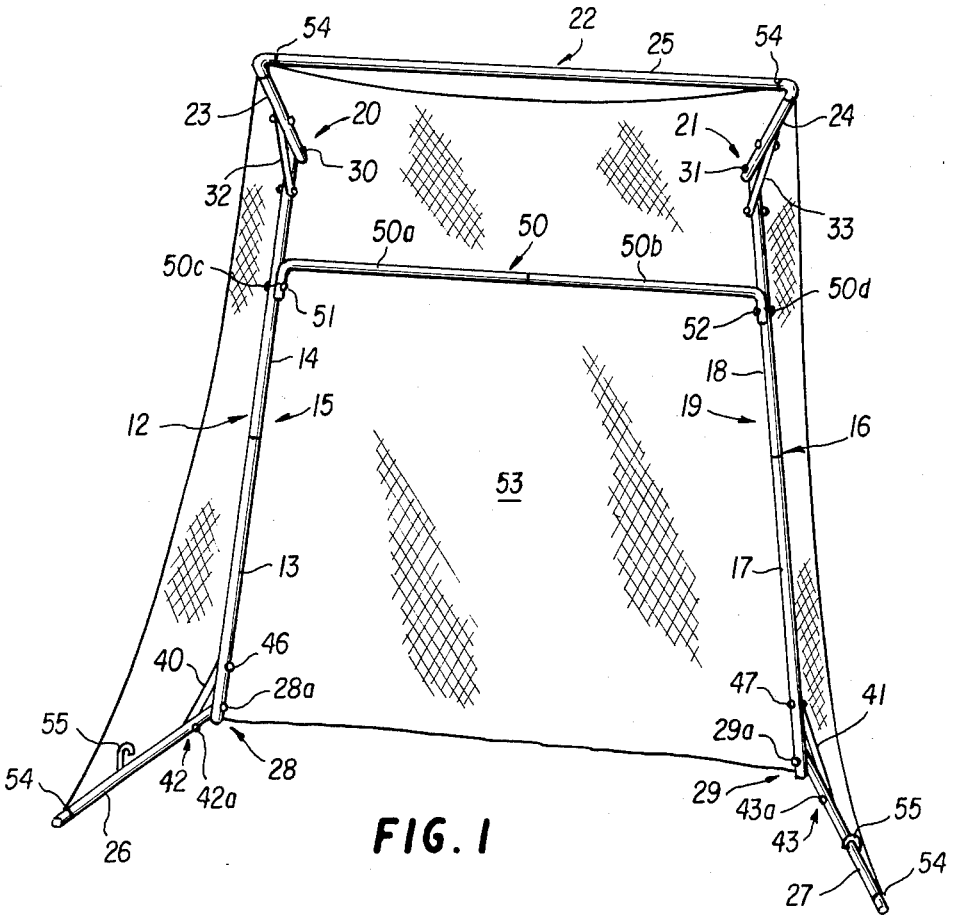
FIG. 1 is a front elevation view of the present invention.
Figure 2:
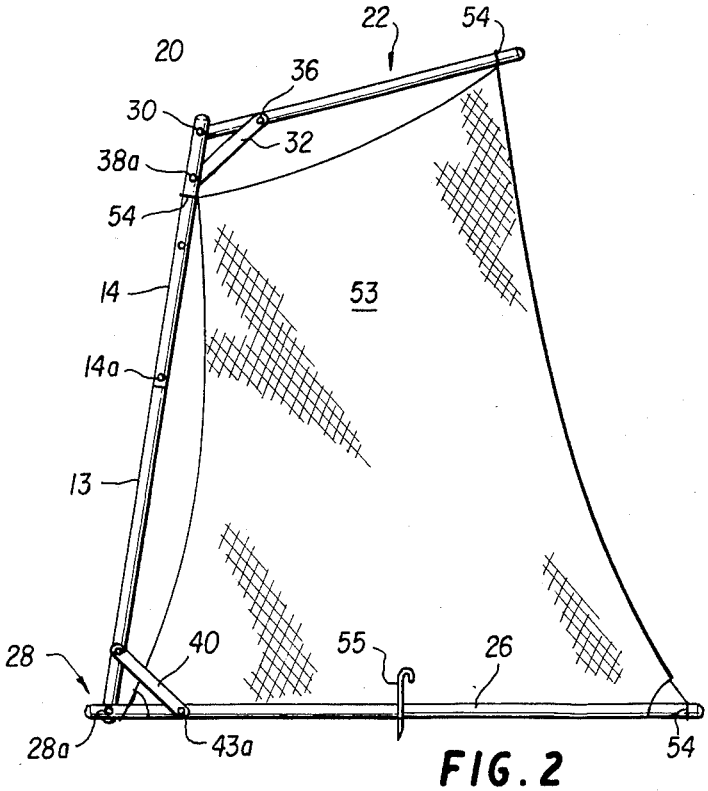
FIG. 2 is a left side elevation view of the present invention seen in FIG. 1, the right side elevation view being substantially identical.
Figure 3:
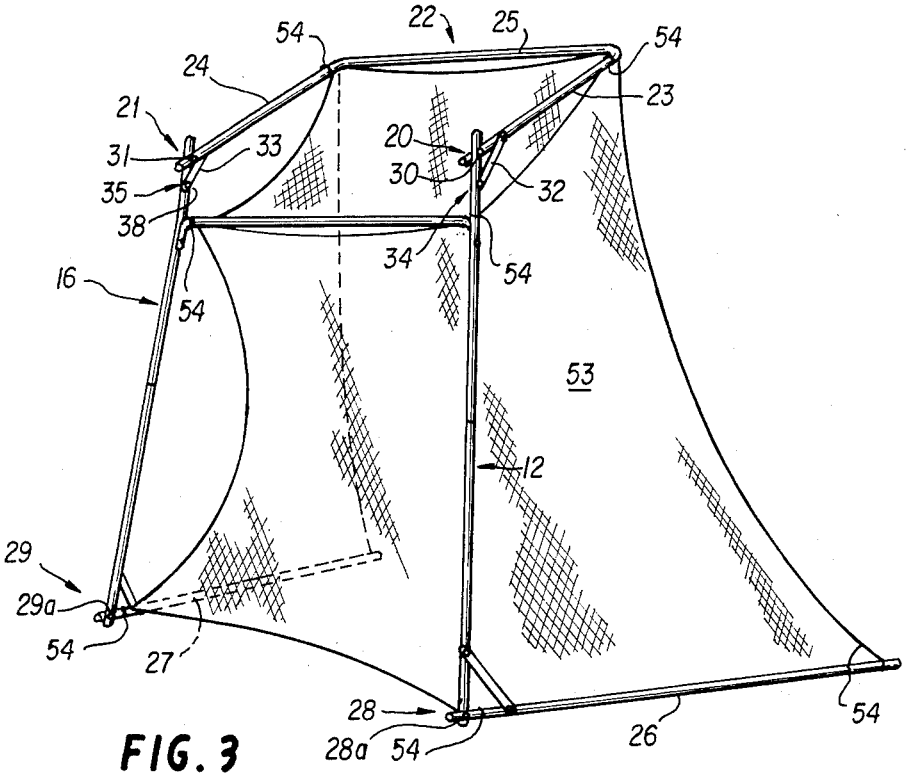
FIG. 3 is a perspective view in elevation of the back side of the present invention.
Figure 8:
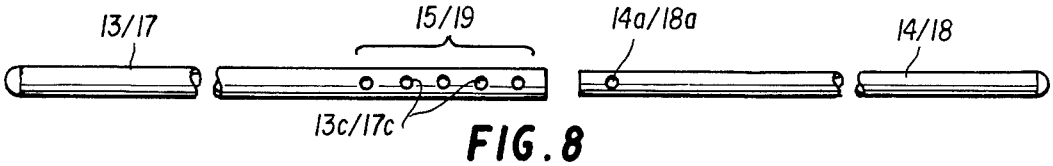
FIG. 8 is a plan view of either of the vertical support members before assembly to show the height adjustment means.
Figure 11:
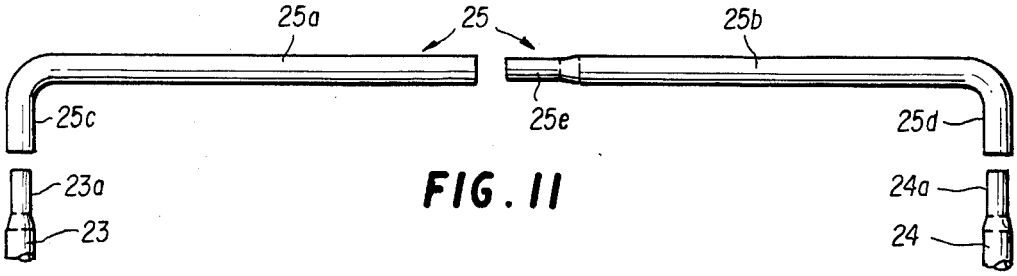
FIG. 11 is an elevation view of the cross bar of the canopy assembly.

With reference to FIGS. 1–3, the invention comprises left vertical support assembly 12 which consists of left lower vertical support member 13, left upper support member 14 having a height adjustment portion 15 (FIG. 8). On the opposite side is right vertical support assembly 16 which consists of right vertical lower support member 17, right upper support member 18 having a height adjustment portion 19 (FIG. 8). Pivotally attached to the upper end of members 14 and 18, by pivotable connections 20 and 21 respectively, is forwardly extending canopy assembly 22. Canopy assembly 22 comprises an inverted U-shaped frame having at left member 23 pivotally attached also to left upper support member 14, right member 24 pivotally attached at 21 to right upper support member 18. Interconnecting the outer ends of members 23 and 24 is cross bar member 25 (FIG. 11).

For stability the invention further comprises left and right forwardly extending ground support means comprising member 26 and 27, member 26 being pivotally attached at 28, to the lower end of left lower support member 13 by bolt means **28*a*, member 27 being pivotally attached at 29 to the lower end of right lower support member 17 by bolt means 29*a*. When assembled, right and left outwardly extending ground support members 26 and 27 are of a length substantially twice the forwardly extending reach of canopy assembly 22**.

Figure 4:
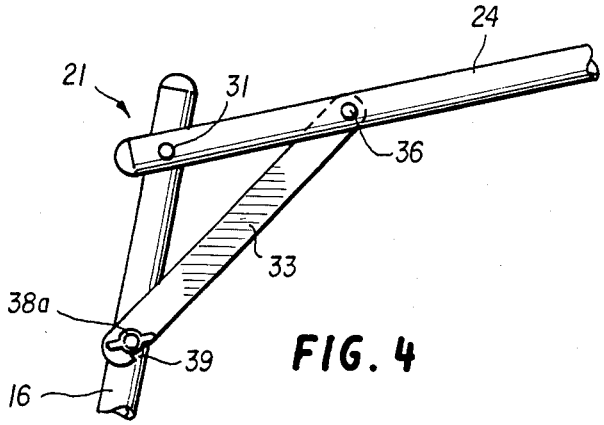
FIG. 4 is an elevation view of the interior of the connection of the top of the left upright support and the left side of the overhead frame, the view of the right side of the invention being substantially identical.
Figure 6:
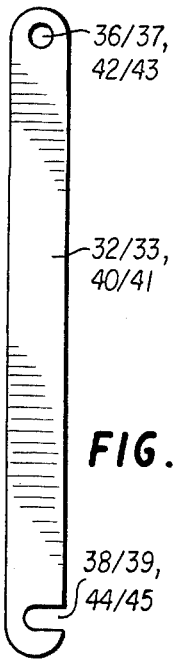
FIG. 6 is a plan view of the pivotal support bracket seen in FIGS. 4 and 5.

The canopy assembly 22 is pivotally attached at 20 and 21, respectively, to the upper end of left vertical support assembly 12 and to the upper end of right vertical support assembly 16 by bolt means 30 and 31. Bracket support means 32 and 33 (FIGS. 4 and 6) for canopy assembly 22 respectively which, each in turn, are pivotally attached at 34 and 35, respectively, to the upper end portions respectively of left vertical support assembly 12 and right vertical support assembly 16 by bolt means 36 and 37. Recesses 38 and 39 (FIG. 6) in bracket support means 32 and 33 engage bolt and wing nut means 38 and 39 respectively extending through the back end portions of left member 23 and right member 24 of the canopy frame assembly 22.

Figure 5:
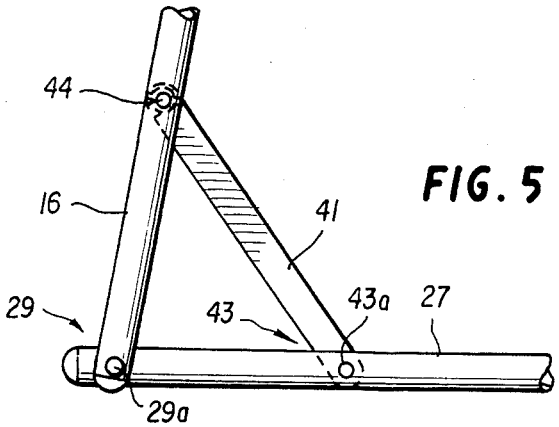
FIG. 5 is an elevation view of the interior of the connection of the bottom of the right upright support member and right side of the right side ground support member, the view of the left side of the invention being substantially identical.

Bracket support means 40 and 41 of the vertical support assemblies 12 and 16 (FIGS. 5 and 6) are pivotally attached at 42 and 43 by bolt means 42a and 43a to the inner end portions of left ground support member 26 and right ground support member 27. The unattached ends of bracket means 40 and 41 each carry recesses 44 and 45 which engage bolt and wing nut means 46 and 47 in the lower portions of support members 13 and 16.

As stated above, the vertical support assemblies 12 and 13 of the present invention include height adjustment positions 15 and 19 (FIG. 8) which permits the present invention to be used in a room of normal height and in an area which is not constricted by the height of the overhead. To this end, each vertical support member is composed of two lower parts 13 and 17 and two upper parts 14 and 18 respectively. Lower parts 13 and 17 are made of 1⅛ inch pipe stock with a plurality of passageways **15*c* and 19*c* (FIG. 8) in the upper end portions. Upper parts 14 and 18 are made of one inch pipe stock which is slideably fitted into the upper ends of parts 13 and 17. The lower end portions of parts 14 and 18 each has a passageway 14*a* and 18*a* which, when the lower ends 14 and 18 are fitted into the upper ends of left and right lower support members 14 and 17, can be aligned with the desired one of passageways 15*c* and 19*c* and bolt and nut means 48 and 49** can be inserted to lock the upper and lower members together.

Figure 9:
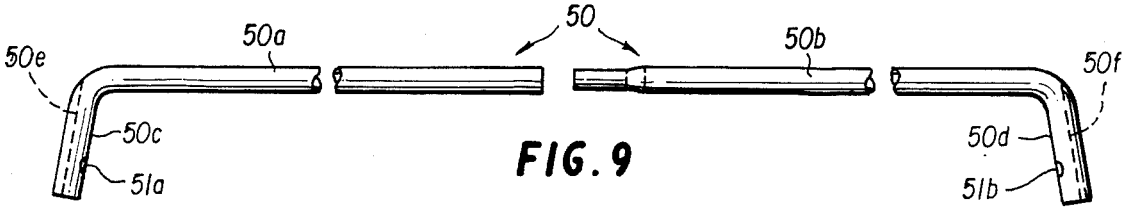
FIG. 9 is an elevation view of the cross brace of the vertical support assembly.
Figure 10:
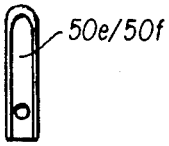
FIG. 10 is an elevation of an end of the cross brace in FIG. 9.
Figure 12:
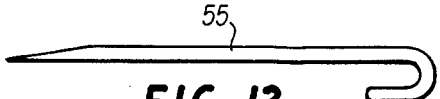
FIG. 12 is a plan view of the hold down rod used with the present invention.

Lateral stability of the vertical support assemblies 12 and 13, in addition to the stability provided by the canopy assembly 22, is provided by cross brace 50 (FIG. 9 and 10) which is attached by bolt means 50 and 51 and 52 to upper vertical members 14 and 18 respectively. Brace 50 is comprised of left and right portions **50*a* and 50*b*, the exterior end of each portion 50*c* and 50*d* being bent downward as shown in FIGS. 9 and 10, with an opening 50*e* and 50*f* cut in the outer surface of each bend to receive upper vertical members 14 and 18 and passageways 51*a* and 52*a* are cut to receive bolt means 51 and 52**.

The construction of vertical support assemblies 12 and 13 has been described. All other assemblies are made from one inch pipe stock. Ground support assemblies 26 and 27, canopy crossbar member 25 and cross brace 50 are each of two parts, the inner end of one part being swedged (i.e., as seen in FIGS. 9 and 11) so as to be slidably received and frictionally held within the inner end of the other part. The outer ends of canopy cross bar members 25 are bent 90° to receive the other swedged ends of left and right members 23 and 24.

Figure 7:
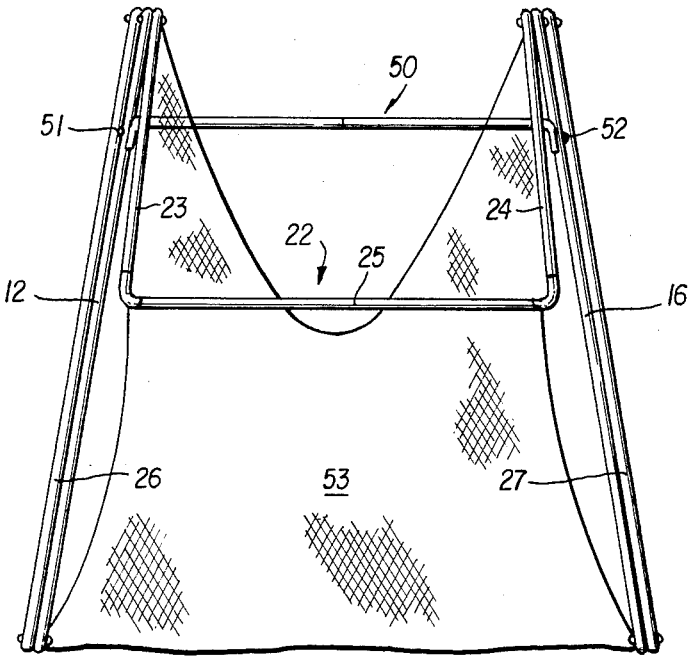
FIG. 7 is an elevation showing of the present invention in the storage or transport position.

Net 53 is provided with a plurality of ties 54 to secure the net to the assembled frame. Groundstakes 55 comprising a rod with a hook on one end are provided to stake the assembly down when it is placed outdoors and left there for use. When it is desired to move the invention or to place it in storage, bracket support means 32, 33, 40 and 41 are disengaged from vertical support assemblies 12 and 13 and ground support members 26 and 27, thus allowing the canopy assembly 22 to be pivoted downwardly and the ground support members 26 and 27 to be pivoted upwardly as shown in FIG. 7.

What is claimed is:

1. A device for practicing golf strokes comprising a substantially vertically positioned support assembly; a U-shaped canopy asssembly extending forwardly of, and upwardly from, said support assembly and pivotally connected at its open end to the upper end of said support assembly; canopy bracket support means pivotally attached at one end to the upper portions of said vertical support assembly, the other end of said bracket support means lockingly engaging the open end portions of the canopy assembly; ground support means comprising two spaced apart hollow rods pivotally attached to the lower ends of said vertical support assembly and each rod extending forwardly of, and laterally outwardly from said vertical support assembly and adapted for vertical upward movement to said vertical support assembly; ground support means brackets pivotally attached at one end to the lower portions of said vertical support assembly, the other end of said ground support means brackets lockingly engaging the pivotally connected end portions of the ground support means; and a single net having means to secure the edges thereof to the vertical support assembly, the canopy assembly and the ground support means.

2. The device according to claim 1 wherein said vertical support assembly comprises two spaced apart hollow rod means, each means comprising an upper pipe slidably mounted over a lower pipe and a cross bar interconnecting the upper portions of said upper pipes, said rod means having means therein to slidably adjust the height of said assembly.

3. The device according to claim 2 wherein said height adjustment means changes said height in predetermined increments by means of a plurality of holes drilled through the upper end portions of said lower pipes at predetermined vertical intervals and matching holes drilled in the lower end portions of said upper pipes and a locking pin to interconnect said pipes at said holes.

4. The device according to claim 2 wherein said hollow rod means are inclined inwardly toward each other so as to form with said cross bar a substantially trapezoidaly shape, the end portions of said upper pipes above said cross bar being swaged outwardly to a vertical position to received the pivotally connected open end of said canopy assembly.

5. The device according to claim 1 wherein said canopy assembly is adapted to be folded down against said vertical support assembly when said other end of said canopy bracket support means is disengaged from the open end portions of said canopy assembly.

* * * * *